United States Patent [19]

Hortel et al.

[11] Patent Number: 4,740,326

[45] Date of Patent: Apr. 26, 1988

[54] SOIL RELEASE POLYMER COATED SUBSTRATE CONTAINING A LAUNDRY DETERGENT FOR IMPROVED CLEANING PERFORMANCE

[75] Inventors: Thomas C. Hortel; Allen D. Clauss; Leonard Williamson, all of Cincinnati, Ohio

[73] Assignee: The Procter & Gamble Company, Cincinnati, Ohio

[21] Appl. No.: 17,103

[22] Filed: Feb. 19, 1987

[51] Int. Cl.[4] ..... C11D 17/00; C11D 17/04; C11D 17/06

[52] U.S. Cl. ..... 252/90; 15/104.93; 252/93; 252/134; 252/174; 252/DIG. 15; 427/242; 427/393.4

[58] Field of Search ..... 252/90, 93; 15/104.93; 427/393.4, 242

[56] References Cited

U.S. PATENT DOCUMENTS

| | | | |
|---|---|---|---|
| 3,632,396 | 4/1969 | Zamora | 117/76 |
| 4,000,093 | 12/1976 | Nicol et al. | 252/529 |
| 4,020,015 | 4/1977 | Bevan | 252/544 |
| 4,082,678 | 4/1978 | Pracht et al. | 252/8.6 |
| 4,116,885 | 9/1978 | Derstadt et al. | 252/532 |
| 4,132,680 | 1/1979 | Nicol | 252/547 |
| 4,136,038 | 1/1979 | Pracht | 252/8.8 |
| 4,238,531 | 12/1980 | Rudy | 427/242 |
| 4,348,293 | 9/1982 | Clarke | 252/90 |
| 4,374,747 | 2/1983 | Tai | 252/186.26 |
| 4,532,063 | 7/1985 | Gueldensopf | 252/90 |
| 4,564,463 | 1/1986 | Secemski et al. | 427/174.17 |
| 4,659,496 | 4/1987 | Klemm | 252/90 |

*Primary Examiner*—Paul Lieberman
*Assistant Examiner*—Kathleen Markowski
*Attorney, Agent, or Firm*—Leonard Williamson; Richard C. Witte

[57] ABSTRACT

The present invention relates to improved laundry cleaning products and methods comprising the use of a soil release polymer coated substrate and a laundry detergent composition contained by the coated substrate for improved soil release and cleaning performance.

13 Claims, 2 Drawing Sheets

SOIL RELEASE POLYMER COATED SUBSTRATE CONTAINING A LAUNDRY DETERGENT FOR IMPROVED CLEANING PERFORMANCE

FIELD OF THE INVENTION

This invention relates to laundry articles and methods comprising soil release polymers.

BACKGROUND OF THE INVENTION

The use of soil release agents in laundry products per se is known in the art.

Examples of laundry detergent compositions containing cellulose ether soil release agents are disclosed in U.S. Pat. Nos. 4,000,093, C. H. Nicol and M. E. Burns, issued Dec. 28, 1976; 4,100,094, M. E. Burns, issued July 11, 1978; and 4,564,463, Secemski et al., issued Jan. 14, 1986. Examples of laundry presoak compositions and rinse additive compositions containing cellulose ether soil release agents are disclosed in U.S. Pat. No. 4,136,038, H. J. Pracht and M. E., Burns, issued Jan. 23, 1979. Examples of laundry detergent compositions containing terephthalate ester/ethylene oxide copolymers are disclosed in U.S. Pat. NoS. 4,132,680, C. H. Nicol, issued Jan. 2, 1979; 4,116,885, Derstadt et al., issued Sept. 26, 1978; and 4,411,831, Robinson et al., issued Oct. 25, 1983.

U.S. Pat. No. 4,348,293, D. E. Clark et al., issued Sept. 7, 1982, discloses the use of a wide variety of water-soluble and water-dispersible coating materials to coat water-insoluble, water-permeable detergent pouches. U.S. Pat. No. 4,374,747, H. T. Tai, issued Feb. 22, 1983, discloses a variety of organic materials suitable for coating water-insoluble, water-permeable bleach pouches such that the coatings are removed by water in the temperature range of 35°–70°C. None of the coating materials disclosed in U.S. Pat. Nos. 4,348,293 and 4,374,747 are believed to be effective soil release agents.

U.S. Pat. No. 4,082,678, H. J. Pracht and L. F. Wong, issued Apr. 4, 1978, discloses a through-the-wash fabric conditioning article with an inner receptacle and an outer receptacle.

U.S. Pat. No. 4,532,063, T. G. Gueldensopf, issued July 30, 1985, discloses a fully dissolving bleach sheet comprising a bleaching compound and a sheet made from a water-soluble filmforming polymer, a solubilizer and a surfactant. This latter patent does not appear to disclose water-insoluble sheets having a coating of soil release agent.

U.S. Pat. No. 3,632,396, Zamora, issued Apr. 28, 1969, discloses substrates coated with a substantially solid, waxy, cationic or nonionic material and an outer coating of a fabric softener and, optionally, an unspecified soil release agent for use in an automatic rinse cycle of a washer or an automatic clothes dryer. U.S. pat. No. 4,238,531, Rudy et al., issued Dec. 9, 1980, discloses in its Examples 8 and 9 a soil release agent adjuvant plus a "distributing aid," polyethylene glycol (PEG) for an automatic clothes dryer.

In none of the above disclosures was there an indication of superior or synergistic soil release performance benefits in using any type of in-the-wash cleaning composition in combination with a substrate coated with a soil release polymer.

OBJECTS OF THE INVENTION

It is an object of the present invention to provide an improved laundry cleaning product which provides superior cleaning of hydrophobic soils on synthetic fabrics and synthetic natural blend fabrics.

It is a further object of the present invention to provide laundry cleaning products which employ a soil release polymer coated substrate to achieve cleaning performance beyond that possible with a comparable amount of the soil release polymer delivered from a free granular or liquid composition.

It is yet another object of this invention to provide a more cost-effective laundry product in which a soil release polymer is included.

These and other objects of this invention will become apparent in the light of the following disclosure.

SUMMARY OF THE INVENTION

This invention relates to a laundry product comprising an effective amount of a soil release polymer (SRP) coated on a surface of a substrate material. The coated substrate material is used to carry a laundry detergent composition into an aqueous laundry solution. The soil release polymer and laundry detergent composition are substantially distinct components of the product.

DETAILED DESCRIPTION OF THE INVENTION

Figure 1:
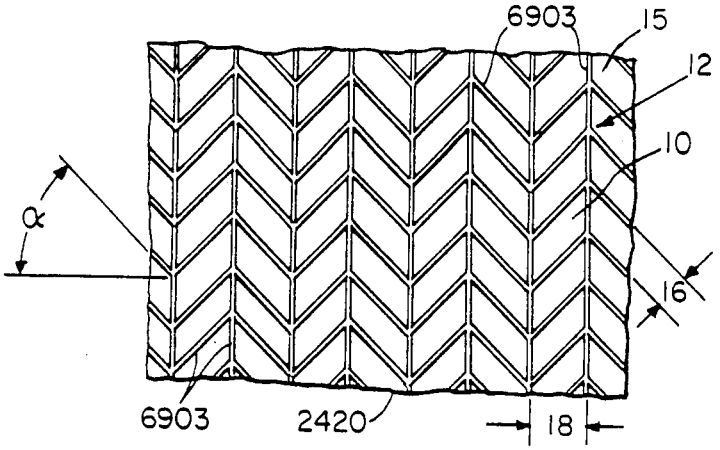
FIG. 1 shows a substrate section having soil release polymer 15 coated over a spaced-apart herringbone pattern of glue.

The present invention relates to a laundry product adapted to provide soil release and cleaning benefits within a wash solution. The product comprises:

(a) a soil release polymer (SRP) selected from water-soluble and water-dispersible soil release polymers and mixtures thereof;

(b) a water-permeable, water-insoluble substrate; and (c) a water-soluble laundry detergent composition;

wherein the soil release polymer is coated on a surface of the substrate and said (c) is contained by the coated substrate; and wherein said (a) and (c) are substantially distinct.

The term "coated on" as used herein means coated on an outer surface of or impregnated into a substrate material used as an inner ply or an outer ply. The term "exposed surface" as used herein includes either the inside surface or the outside surface of water-insoluble, water-permeable pouches.

The term "contained" as used herein means either "enclosed within, impregnated into, or coated on," unless otherwise specified. The terms "laundering composition" and "laundry detergent composition" as used herein are synonymous, unless otherwise specified. The term "substantially distinct" means not an intimate mixture.

The present invention provides an unexpectedly superior laundry cleaning product and process.

The present invention can be in the form of a single sheet, a pouch, a bag, or the like. Preferably, the present invention is incorporated into a fully formulated, stand along product. The soil release polymer-coated substrate is substantially dry, but the article of manufacture can be in part a liquid or paste.

The preferred detergent contains surfactants, builders, water-soluble bleaches, bleach activators, enzymes, brighteners, etc. The detergent composition of this invention delivers from about 50 ppm to about 1,000 ppm of surfactant to the laundry solution preferably from about 100 to about 600 ppm on a 68 liter laundering solution basis.

Preferred embodiments of the present invention comprise an effective amount of soil release polymer and a laundry cleaning composition which work in the wash solution. The soil release polymer is preferably present as a usage unit amount in the article so as to provide 1 ppm to 100 ppm of soil release polymer to the wash, more preferably from about 2 ppm to about 50 ppm, and most preferably from about 5 ppm to about 25 ppm.

Any soil release polymer suitable for coating a substrate can be used in the present invention. For example, two general classes of nonionic water-soluble or water-dispersible polymers, cellulose ethers, and terephthalate ester/ethylene oxide copolymers provide soil release benefits. While not being bound to any theory, it is believed that they do this by adsorbing onto fabrics, particularly synthetic fabrics such as polyester, such that stains, particularly greasy stains, subsequently transferred to the fabric are more easily removed in the next wash cycle.

Preferred soil release polymers are selected from the following:

A. alkyl, hydroxyalkyl and mixed alkyl/hydroxyalkyl ethers of cellulose containing from one to four carbon atoms in the alkyl and hydroxyalkyl moieties and having a molar degree of substitution of about 1.5 to about 2.7 and a number average molecular weight of about 2,000 to 1000,000;

B. polymers comprising ethylene terephthalate and polethylene oxide terephthalate at mole ratio from about 1:10 to 10:1, said polyethylene oxide terephthalate containing polyethylene oxide units with a number average molecular weight from about 500 to about 10,000, and said soil release polymer having a number average molecular weight of about 1,000 to 100,000;

C. polymers comprising propylene terephthalate and polyethylene oxide terephthalate at a mole ratio from about 1:10 to about 10:1, said polyethylene oxide terephthalate containing polyethylene oxide units with a number average molecular weight from about 500 to about 10,000, and said soil release polymer having a number average molecular weight of about 1,000 to 100,000;

D. polymers comprising ethylene terephthalate and/or propylene terephthalate in any ratio and polyethylene oxide and/or polypropylene oxide in any ratio such that the mole ratio of ethylene terephthalate plus propylene terephthalate to polyethylene oxide plus propylene oxide is from about 1:10 to about 10:1, said polyethylene oxide units and said polypropylene oxide units each having a number average molecular weight from about 250 to about 10,000, and said soil release polymer having a number average molecular weight of about 1,000 to about 100,000.

Any combination of the above soil release polymers can be used.

Particularly preferred soil release agents are mixtures of from about 20% to about 80% a polymer selected from A, preferably a methylcellulose, and from about 20% to about 80% of a polymer selected from the group consisting of B, C and D and mixtures thereof; more preferably a mixture of from about 30% to about 70% of A and from about 30% to about 70% B, C or D.

It is essential aspect of the present invention that the soil release polymer be formulated and delivered in a manner that provides adsorption of this active to hydrophobic synthetic fabrics during the laundry process. Ideally the polymer is delivered in such a way and at levels which provide essentially the maximum soil release effect after a single wash-rinse-dry laundering. While not being bound to any theory, it is believed that the unexpected results are due to the delivery of the soil release polymer to fabric with minimal interaction of the soil release polymer with the detergent surfactant. It was unexpectedly and surprisingly discovered that superior soil release advantages can be observed in the second washing of synthetic garments when the soil release polymer is coated on a surface of the product substrate and is substantially distinct from the detergent composition.

Most or all of the soil release polymer on the coated substrate of this invention is preferably delivered in the wash cycle. The efficiency of deposition on fabric and consequent soil release performance is dependent on the selection of the soil release polymer, detergent builder and surfactant actives. Most known laundry surfactants can be used. Preferably an anionic surfactant system is used. Such a system preferably has at least about 50% anionic surfactant, but can contain less. See U.S. pat. No. 4,100,094, Burns et al., issued July 11, 1978, incorporated herein by reference, for a disclosure of suitable surfactants useful in the present invention.

Soil Release Agent Coated Substrate

The present invention provides an improved method of delivery of the soil release polymer which results in significant laundering performance improvements. This present method comprises coating a soil release polymer onto a water-permeable, water-insoluble substrate material, which in turn is used to contain a detergent and/or bleaching composition. In a preferred embodiment the product is in the form of a pouch made with the coated substrate. The soil release polymer can be coated onto the inside or the outside of some pouch substrate materials, or it can be impregnated throughout substrate void spaces. It can also be coated on an inner ply of a multi-ply laminate or cast as a separate independent soil release polymeric film and attached to another substrate pouch material.

The substrate can take almost any physical form including pouches, sheets, webs, sponges, cups, etc. It may consist of water-permeable, nondissolving, or partially dissolving material. The preferred substrates are fibrous substrates made from polyesters, polyolefins, nylons, rayons, cellulose, mixtures thereof, and the life. Preferred spun-bonded polyester substrates are commercially available from DuPont under the Reemay® trade name. Properties of some preferred Reemay substrates are summarized in Table 1.

TABLE 1

Typical Physical Properties* of REEMAY$^R$ Spunbonded Polyester

| Style | Unit Weight oz/yd$^2$ | Unit Weight g/m$^2$ | Thickness mils | Sheet Grab Tensile MD lbs. | Sheet Grab Tensile XD lbs. | Trapezoid Tear MD lbs. | Trapezoid Tear XD lbs. | Mullen Burst psi | Mullen Burst kPa | Frazier Air Perm. @ 0.5" $H_2O$ |
|---|---|---|---|---|---|---|---|---|---|---|
| 2200 | 1.0 | 34 | 7 | 21 | 19 | 7 | 8 | 15 | 103 | 650 |
| 2214 | 1.35 | 50 | 10 | 33 | 34 | 11 | 11 | 34 | 234 | 525 |
| 2295 | 2.95 | 100 | 18 | 73 | 70 | 16 | 17 | 76 | 524 | 300 |
| 2410 | 1.15 | 39 | 11 | 14 | 11 | 6 | 6 | 9 | 62 | 975 |
| 2415 | 1.55 | 53 | 14 | 22 | 16 | 11 | 9 | 16 | 110 | 700 |
| 2420 | 1.85 | 63 | 15 | 28 | 22 | 13 | 11 | 18 | 124 | 650 |
| 2430 | 2.4 | 81 | 17 | 39 | 32 | 17 | 14 | 29 | 200 | 425 |
| 2440 | 2.9 | 98 | 18 | 51 | 45 | 19 | 16 | 38 | 262 | 350 |

*These are typical properties and should be used as a guide only.
Note: Reemay ® R is a regstered trademark of the DuPont Company, Wilmington, Delaware. The above data are published in one of DuPont's bulletins. Styles are subject to change. The above data are reported as average properties.

The substrates can include staple fibers and continuous fibers. An example of a preferred nonpilling fibrous substrate is Kiara ® 9116, a 1.3 oz/yd$^2$ (44 g/m$^2$) basis weight of carded polyethylene/polyester bicomponent fibers, commercially available from Chicopee Corporation.

Another example of a preferred substrate is James River 5227, a wet laid polyester/pulp fabric bland with a basis weight of 1.15 ounces per square yard (38.9 grams per square meter) made by James River Corporation. This substrate 5227 has about 90% polyester and 10% cellulosic fibers and a Frazier air permeability of 586 ±12 and a mean pore diameter of 0.022 mm. See Table 2 for more details on 5227.

TABLE 2

James River 5227 Substrate Physical Properties

| | MD | XD |
|---|---|---|
| Breaking Load | 4.31 ± 0.28 | 4.31 ± 0.22 |
| Elongation | 13.0 ± 2.0 | 23.0 ± 2.0 |

In one preferred embodiment, a pun-bonded polyester nonwoven substrate such as DuPont Reemay 2420 is coated with a methylcellulose soil release polymer such as Dow Methocel A-15LV by immersing the substrate in a 5° C. to 50° C. (dependent on methylcellulose concentration), preferably 25° C., aqueous solution containing from about 1% to about 25%, preferably 5–20% of the methylcellulose and from about 0.1% to about 10%, preferably 1–5% propylene glycol plasticizer. The substrate is then run through nip rollers to remove the excess coating solution and dried at room temperature.

In another preferred embodiment, a wet laid polyester/-cellulosic nonwoven substrate, such as James River 5227, commercially available from James River Corporation, Greenville, S.C., is coated with Dow Methocel A-15LV. One side of the substrate is contacted with the solution described above and excess removed by repeatedly contacting the coated side of the substrate with a smooth dry surface until the level of wet coating on the substrate is about 0.14 grams per square inch. A target level is a dry soil release polymer coating of about 0.011 grams per square inch (17 grams per sq. meter). The resultant coated substrate material is particularly suitable for making pouched detergent, bleach, or combination detergent/bleach products which provide enhanced wash cycle cleaning and soil release performance.

When the present invention comprises a soil release polymer coated pouch, bag, or the like, a preferred pouch substrate material is a suitable nonwoven. Some examples of such nonwovens are set out in the examples. Other suitable substrates are also taught in U.S. Pat. Nos. 4,113,630, Hagner et al., issued Sept. 12, 1978; 4,108,600, Wong, issued Aug. 22, 1978, and 4,638,907, Bedenk & Harden, issued Jan. 27, 1987; and allowed U.S. Ser. No. 748,654, Strampach et al., filed June 25, 1985, all incorporated herein by reference in their entirety. It is advantageous to include a substrate which contains or supports the laundering compositions (active ingredients) in a premeasured, single use amount and releases them at the desired point in the wash, rinse or drying cycle. The substrate may also be used to separate or compartmentalize incompatible ingredients until they are released in the laundering process. As described above, a specially designed substrate may be particularly useful to effect a sequenced delivery in which the SRP detergent and bleach ingredients are released in the wash cycle and some other active is released in the wash and/or rinse cycles.

An example of a particularly useful substrate for the present invention is a two-ply multi-pouched laminated article disclosed in U.S. Pat. No. 4,638,907, supra, incorporated herein by reference in its entirety. It may also consist of a single sheet with the laundering composition impregnated in a porous water-insoluble substrate with soil release polymer coated thereon as a separate layer.

DETAILED DESCRIPTION OF THE DRAWINGS

FIG. 1 shows a section of a substrate 2420 having soil release polymer coating 15 and a spaced-apart herringbone glue pattern 12. This substrate is coated with soil release polymer 15. The distances 18 are about 0.222 inch (0.56 cm) and the distances 16 between the 45° alpha angled are about 0.11 inch (0.28 cm). There are unglued substrate spaces 10 in between the glue patterned 12 lines. Some illustrative dimensions and characteristics of substrate 2420 are shown in Table 1.

Figure 2:
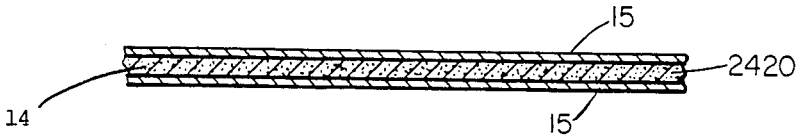
FIG. 2 is a cross-sectional view of a water-permeable water-insoluble substrate 2420 with impregnated detergent 14 and coated with soil release polymer 15 on both sides.

FIG. 2 is a cross-sectional view of a single substrate 2420 product with surfactant detergent 14 impregnated into the substrate 2420 and soil release polymer 15 coated on both sides.

Figure 3:
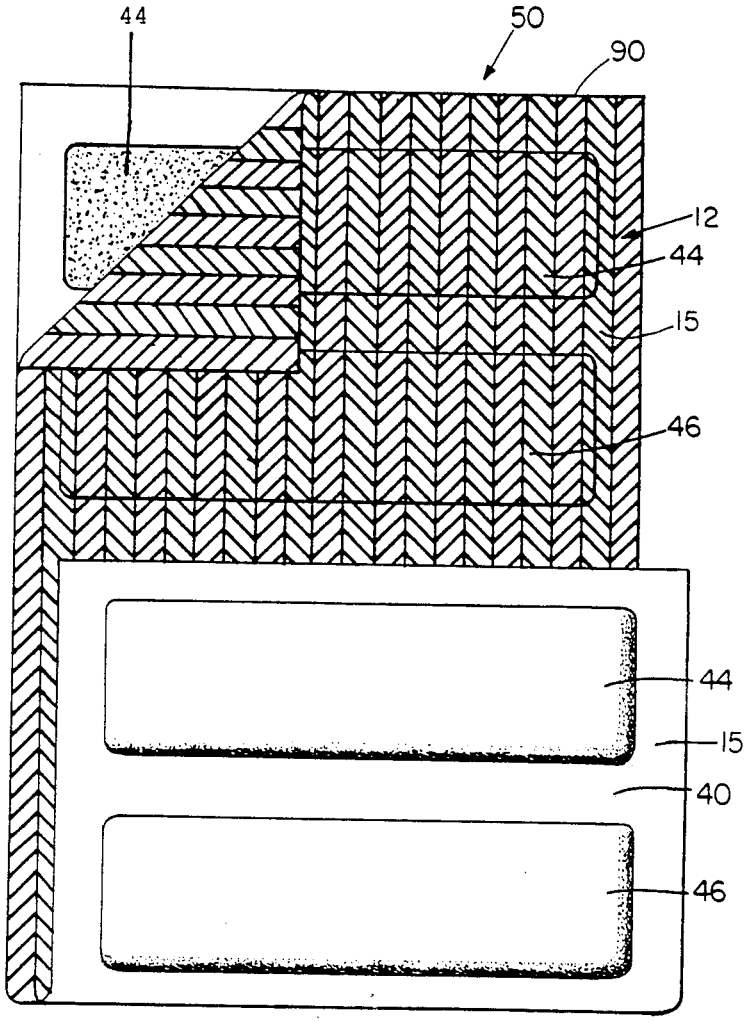
FIG. 3 shows a 6-celled 2-ply laminated, multi-pouched, multi-action laundry product with soil release polymer 15 coating on the outer surfaces of both plies.

FIG. 3 is a top and bottom view of a folded, laminated, 6-celled multi-pouched laundry product sheet 50. Soil release polymer 15 is coated on the outside exposed surfaces of both the top 90 and bottom 40 substrates. A corner of one cell 44 is peeled back. The product sheet 50 has four cells of softener/detergent 46. The top unembossed sheet substrate 90 is shown with the spaced-apart herringbone glue pattern 12. Particulate softener particles are contained throughout the 6-multi-pouched sheet. The product sheet 50 has two mini-pouches (cells) of softener/bleach (whiteners and stain removers) 44; one on each end of product sheet 50. Two cells of the softener/detergent 46 are covered over (hence, not shown) because two cells are folded over them to show the embossed bottom sheet 40, which has no spaced-apart glue pattern.

Alluding to FIG. 3, the top sheet 90 of a two ply laminated pouch can be made of any suitable pouch substrate material including paper, nonwoven synthetics such as spunbonded polyester, porous forming film plastic sheet material and combinations, thereof. A suitable top sheet ply is made of a strengthened tissue similar to the one described in Example II of allowed U.S. Patent Application Ser. No. 748,654, Strampach et al., filed June 25, 1985, incorporated herein by reference in its entirety.

Preferred Embodiments

The present invention is preferably used as part of a fully formulated stand-alone laundry product wherein appropriate soil release polymers and detergent components are present and released in the wash along with a peroxyacid bleach and a fabric softener is released in the dryer. Useful detergent compositions for use with this invention can include essentially any typical laundry detergent containing one or more types of organic surfactant along with detergency adjunct materials. The organic surfactant is selected from the group consisting of anionic, nonionic, ampholytic and zwitterionic surfactants, and mixtures thereof. U.S. Pat. No. 3,664,961, Norris issued May 23, 1972, incorporated herein by reference, describes at Col. 1, line 68, to Col. 9, line 3, suitable surfactants useful herein. The anionic and nonionic surfactants are preferred. Nonlimiting examples of adjunct materials which can be used in the detergent composition include soil suspending agents, perfumes, optical brighteners, bleaches, processing aids, alkalinity sources and enzymes. Nonlimiting examples of powdered detergent materials suitable for use with the present invention are disclosed in U.S. Pat. No. 4,404,128, B. J. Anderson, issued Sept. 13, 1983, incorporated herein by reference.

Through-the-wash fabric softeners can also be used in combination with the components of the present invention. A preferred softener is a particle formulated to survive (i.e., not dissolve in) the wash cycle and preferably also the rinse cycle, and melt and become distributed evenly on the fabric in the clothes dryer step of a laundering process. The softener particle at least 40% by weight. Numerous examples of softener/antistat compositions which function in this manner are taught in the literature, e.g., U.S. Pat. Nos. 4,113,630, supra; and 4,108,600, supra, which are incorporated herein by reference.

The present invention will be further understood by the following nonlimiting examples.

EXAMPLE 1

Some preferred laundering compositions plus fabric softeners are made as follows:

A preferred particulate fabric softener is one comprising an inner core of solid fabric softener composition surrounded by a water-insoluble coating material which melts or disintegrates in the dryer to release the softener at that stage of the laundering process. A preferred softener composition for the core of such a particle has the following formula:

TABLE 3

| Ingredient | Wt. % |
|---|---|
| Ditallowdimethylammonium methylsulfate (DTDMAMS) | 42.4 |
| Sorbitan monostearate | 21.3 |
| Cetyl alcohol | 21.3 |
| Bentonite clay | 12.0 |
| Perfume | 3.0 |
| Total | 100.0 |

Softener Making Process

Step 1

The DTDMAMS is heated in a reaction vessel at 71° C. under vacuum (Ca. 710 mm Hg) for 4 hours to remove residual moisture and/or isopropanol. The catyl alcohol and sorbitan monostearate are then added, and the molten "triblend" is mixed for one hour at about 71° C.

The triblend is transferred into a PVM 40 Ross mixer (Charles Ross & Sons Company, Hauppauge, N.Y. 11788). The temperature of the triblend is then raised to 79° C.–85° C. under vacuum (about 330–430 mm Hg). When the temperature has stabilized in this range, the Ross' anchor and disperser are turned on and the clay is added. The mixture is blended for 5 minutes and then sheared with the Ross' colloid mixer for 20 minutes. The perfume is then added and the mixture is blended for 5 minutes with the anchor, disperser and colloid mill still on. The softener composition is then poured into trays and cooled overnight at about 4° C.

Step 2

The solid softener core composition is then converted to particles by milling in a Fitzmill, Model DA506 (The Fitzpatrick Company, Elmhurst, Ill. 60126) at 4740 rpm's through a 4 mesh screen. The particles are then sized through 12 on 30 (U.S. Standard screens, 1.7–0.6 mm particle size).

Step 3

The particles are then coated with a hot melt of fatty alcohol-based coating. The coating is a mixture of 90% stearyl alcohol and 10% Elvax-4310, a terpolymer of ethylene, vinyl acetate and acid from E. I. du Pont de Nemours & Co., Polymer Products Dept., 1007 Market St., Wilmington, Del. 19898. The coating is applied in an 18 Inch Wurster coater (Coating Place, Inc., P.O. Box 248, Verona, Wisc. 53593). A detailed description of this type of equipment can be found in U.S. Pat. No. 3,196,827, Wurster et al., issued July 27, 1965, incorporated by reference herein.

Briefly, the Wurster Coater consists of an apparatus that is capable of suspending the softener core particles on a rapidly moving warm air stream. Encapsulation is accomplished by passing the softener particles through a zone of finely atomized droplets of coating. As the particles move up and away from the coating nozzle, the coating begins to solidify as the particles cool. When the particles can no longer be fluidized by the air stream, they move down in the opposite direction of the fluidizing air. The coated particles then reenter the coating zone and are recycled until the desired amount of coating is applied. The coating cycle takes place within a single chamber which preferably has a partition to separate the particles moving up through the coating zone from those moving down through the cooling zone.

The following conditions are used to apply a hot melt coating:

| | |
|---|---|
| Stearyl Alcohol/Elvax Temperature | 79° C. |
| Fluidizing Air | 15.8 Cu. M/min. at 40.5° C. |
| Atomizing Air Volume | 0.25 Cu. M/min. |
| Atomizing Air Rate | 4218 g/sq. cm. |
| Inlet Air Temperature | 20° C.-38° C. |
| Outlet Air Temperature | 20° C.-38° C. |
| Pump Rate | 0.2 Kg/min. |
| Nozzle Size | CPI-18-A74* |
| Partition Size | 216 mm × 267 mm |
| Partition Gap | 19 mm |
| Run Time | 22 min. |

*Available from Coating Place, Inc.

The amount of fatty alcohol coating applied to the softener particles is about 15% by weight of the total coated particle. After the coating process is complete the particles are resized through 12 on 20 mesh and are then ready for use "as is" or for blending into detergent and/or bleach granules.

Step 4

Softener core particles prepared as in Step 3 are coated with ethyl cellulose based coating instead of fatty alcohol. The coating is applied by spraying a 10% solids solution in methanol of 9 parts ethyl cellulose and 1 part dibutyl sebacate. The coating is applied in an 18 Inch Wurster coater as described in Step 3. The ethyl cellulose used in Ethocel Std. 4, (Dow Chemical Co., Midland, Mich. 48640) which has an Ubbelhhode viscosity of 3.0-5.5, measured at 25° C. as a 5% solution in 80% toluene/20% ethanol.

The following conditions are used to apply a solvent based coating:

| | |
|---|---|
| Fluidizing Air | 15.8 Cu. M/min. at 40.5° C. |
| Atomizing Air Volume | 0.37 Cu. M/min. |
| Atomizing Air Rate | 5624 g/sq. cm. |
| Inlet Air Temperature | 38° C.-43° C. |
| Outlet Air Temperature | 30° C.-32° C. |
| Pump Rate | 0.2 Kg/min. |
| Nozzle Size | CPI-18-A74* |
| Partition Size | 216 mm × 267 mm |
| Partition Gap | 19 mm |
| Run Time | 120 min. |

*Available from Coating Place, Inc.

The amount of ethyl cellulose/dibutyl sebacate solids coated onto the particles is about 5% by weight of the total coated particle weight. When the coating is completed, the softener particles are resized through 12 on 30 Mesh U.S. Standard screens and are then ready for use "as is" or for blending into detergent granules.

Detergent/Softener Composition A

A granular detergent/softener composition is prepared by mixing 4 parts of the above softener particles of either Step 3 or Step 4 with 96 parts of the following granular detergent composition.

The following is a breakdown of the granular detergent component of Composition A.

| | Base Granules | |
|---|---|---|
| | Weight % | Grams Final Composition Per Use (Ex. III) |
| Sodium $C_{13}$ linear alkylbenzene sulfonate | 22.1 | 5.110 |
| Sodium $C_{14-15}$ alkyl sulfate | 22.1 | 5.110 |
| Sodium silicate (1.6 ratio) | 13.7 | 3.172 |
| Sodium sulfate | 32.2 | 7.455 |
| Polyethylene glycol (MW = 8000) | 1.5 | 0.340 |
| Sodium polyacrylate (MW = 4500) | 2.0 | 0.453 |
| $C_{12-13}$ alcohol polyethyoxylate (6) | 3.0 | 0.680 |
| Sodium diethylenetriamine pentaacetate | 1.5 | 0.340 |
| Moisture | 2.0 | 0.462 |
| | | 23.122 |
| Preblend | | |
| Base granules | | 23.122 |
| Sodium tripolyphosphate hexahydrate (powdered) | | 20.576 |
| | | 43.698 |

| | Grams Final Composition Per Use |
|---|---|
| Admix | |
| Preblend | 43.698 |
| Sodium tripolyphosphate (STP) hexahydrate (granular) | 19.429 |
| Dye | 0.003 |
| Brightener | 0.613 |
| Suds suppressor prill comprising dimethylsilicone, silica, sodium tripolyphosphate and polyethylene glycol (MW = 8000) | 1.703 |
| Protease | 2.044 |
| Sodium carbonate | 4.000 |
| | 71.490 |
| Spray-On | |
| Admix | 71.490 |
| Mineral oil | 0.710 |
| | 72.200 |

The base granules are produced by spray-drying an aqueous crutcher mix of the components on a ten foot tower using a crutcher temperature of 200° F., a size 3-½ nozzle to make fine granules, and silicone deaerants. A second drying stage on a continuous fluid bed is used to reduce moisture to 2%.

The base granules are then admixed with powdered STP hexahydrate to form the preblend. The preblend is compacted at 50 psig roll pressure on a 4 in. by 10 in. chilsonator, and screened to select a −14 (1168 microns)/+65 (208 microns) particle size cut (Tyler mesh). Oversized particles are collected and granulated on a Fitzmill, Model DA506 (The Fitzpatrick Company, Elmhurst, Ill. 60126), using a 14 mesh screen and low rpm's. This is screened to select a −20(833 microns)/+48(295 microns) particle size cut. Both materials are dedusted by blowing off fines in a fluid bed dryer using ambient air.

The admix is prepared as a 400 pound batch in a drum mixer. Carbonate, granular STP (with dye sprayed-on), brightener, enzymes, and suds suppressor prills are blended with the compacted mainstream product cut and regranulated overs at a ratio of mainstream product cut to overs of about 7 to 1. Mineral oil is sprayed on the final admix in 30 to 40 pound batches at a 1% level using a Forberg Mixer.

Bleach/Softener Composition B

A granular bleach/softener composition is prepared by mixing 4 parts of the above softener particles of either Step 3 or Step 4 with 96 parts of the following granular bleach composition prepared using the procedure described in U.S. Pat. No. 4,374,035, supra, (Example I) incorporated herein reference in its entirety.

| Ingredient | Wt. % |
|---|---|
| Diperoxydodecanedioic acid | 24.0 |
| Dodecanedioic acid | 2.9 |
| Sodium $C_{13}$ linear alkylbenzene sulfonate | 5.5 |
| Boric acid | 27.7 |
| Sodium sulfate | 39.7 |
| Miscellaneous | 0.2 |
| Total | 100.0 |

This Composition B is used at a product level to provide about 10 ppm of available oxygen in an 18-gallon wash (68.1 liters).

EXAMPLE II

A preferred softener system to be released in the wash cycle comprises:

| Ingredient | Wt. % |
|---|---|
| Varisoft 445 Imidazoline | 64.7 |
| Stearyl Alcohol | 32.2 |
| Perfume | 3.0 |

This is made by the following steps:

Step 1

A PVM Ross Mixer (Charles Ross & Sons Co., Hauppauge, N.Y. 11788) is heated to about 68° C. The Varisoft 445 imidazoline (Sherex Chemical Co., Inc., Dublin, Ohio) and stearyl alcohol are preweighted and placed in the mixer. The temperature is maintained at 68° C. under a vacuum (165 mm Hg). The Ross anchor is run at low speed to mix this mixture. When the material is semi-molten (white in color), the Ross disperser is turned on (low to medium speed) under a vacuum (165 mm Hg) at 68° C. for 30 minutes. If the material appears to be clear, it is assumed to be molten; if it is not clear, the mixture is mixed an additional 15 minutes. The perfume is then added and the mixture is blended for 5 minutes at 68° C. The softener composition is then poured into trays and cooled overnight at about 4° C.

Step 2

The solid softener core composition is then converted to particles by milling in a Fitzmill, Model DA506 (The Fitzpatrick Co., Elmhurst, Ill. 60126) at high speed through a 4 mesh screen (U.S. Standard screen, 300 micron particle size) using a Rotex automatic screening device. The particles are next sized through a U.S. 100 mesh screen (U.S. Standard screens, 125 micron particle size) using the Rotex automatic screening device.

Step 3

These softener particles are next agglomerated. The softener particles (250 gms) are placed in a Cuisinart DLC -8 Plus (Cuisinarts, Inc., Greenwich, Conn. 06830). Crushed dry ice (approx. 10 gms) is added and the Cuisinart is turned on. Propylene glycol (25 gms) is then added through the small removable pusher. When all the propylene glycol is added, the agglomerated softener is removed and spread on a large tray. The material is left overnight so that most of the propylene glycol will evaporate.

Step 4

This agglomerated softener is then sized through a 35 mesh screen (U.S. Standard screens, 500 micron particle size) using a Rotex automatic screening device.

A unit dose of this softener system per 6-celled multipouched sheet like the one shown in FIG. 3 is about 8.5 grams. Preferably an additional dryer activated softener system like the one disclosed in Example I is also used for maximum softening.

EXAMPLE III

A fibrous nonwoven substrate (DuPont REEMAY ® 2420, a spunbonded, 63 g/m$^2$, 4 denier polyester nonwoven fabric) is printed with a spaced-apart pattern of a hot melt (196°–199° C.) of Henkel 6903 using the following procedure:

Using a Thermo Intaglio Graphics process with a rotogravure hot melt system made by Roto-Therm, Inc., the spaced-apart herringbone glue pattern 12 of FIG. 1 is printed 33 cm wide on a 40 cm wide web of substrate 2420 at a level of about 25 grams per square meter of printed substrate.

An 11.4 cm×28 cm (4.5 in.×11 in.) sheet of the spacedapart, herringbone glue patterned substrate is cut from the web.

The glue pattern occupies about 16% of the surface of substrate 2420 and the other 84% is unglued surface area 10.

EXAMPLE IV

The nonwoven substrate of Example III is coated with soil release polymer according to the following procedure:

About 450 ml of distilled water are added to a 2000 ml stainless steel beaker and heated to 70° C. (158° F). 80 grams of Dow Chemical'Methocel A-15LV Premium Grade methylcellulose are slowly added to the water under good agitation conditions (a vortex is formed). After the methylcellulose is well dispersed, the agitation is reduced to prevent aeration. About 438 grams of 20° C. (68° F.) water are then added to the dispersion. Propylene glycol (32.0 g) is then added. The beaker is then placed in an ice bath and agitation continued until product is clear (an indication that the methylcellulose is dissolved). An 11.4 cm×28 cm (4.5 in.×11 in.) sheet of the substrate at Example III is immersed in the methylcellulose solution. The saturated fabric is then run through an Atlas Electric Devices Co. laboratory wringer (Model LW-1) set at approximately 50 kg (110 lbs.) force. The wrung-out fabric is then line dried in a low humidity environment for 24 hours. The substrate is coated with about 0.54 g of solid coating.

EXAMPLE V

The nonwoven substrate of Example III is coated with soil release polymer according to the following procedure:

About 740 g of distilled water are added to a 2 liter glass beaker and heatd to 82° C. (180° F.). Abou 160 g of Dow Chemical Co.'s Methocel A-15LV Premium Grade methylcellulose are slowly added to the water while mixing vigorously with a Lightnin V7 mixer. This mix is agitated for 15 minutes to thoroughly disperse the methylcellulose. Next, 64 g of propylene glycol is added to the dispersion. This is immediately followed by the addition of about 1035 g of 7° C. (45° F.) distilled water to the dispersion. Agitation is continued for about 5 minutes until the product is clear (an indication that the methylcellulose is dissolved). Some of this viscous solution s poured onto a plastic tray and spread over the tray with a spatula. A 29.2 cm×38.1 cm (11.5 inch×15.0 inch) sheet of the nonwoven substrate of Example III is laid in the tray on the solution. The sheet is then peeled from the tray and again laid inthe solution. This is done several times to evenly coat the one side contacting the solution. A sheet weight is taken to determine the coating level. Additional solution can be coated on the sheet by adding more solution to the tray, spreading it, and then repeating the lay and peel technique previously described. If the coating level is too high, the sheet can be laid in a second dry tray to transfer off some of the coating and thereby reduce the level. The level of wet coating on the sheet is adjusted to about 11.3 grams. The coated sheet is then hung to dry at room temperature for about 24 hours. The dry coating weight (ca 0.9 g) is calculated as the difference between the final (dry) weight and the weight of the substrate before coating. The substrate is then cut to 11.4 cm×28 cm (4.5 inch.×11 inch) sheets, each containing abou 0.27 g of soil release polymer coating, to be used in making a laminated product.

EXAMPLE VI

A preferred mode 6-celled multi-pouched laundry product consisting of soil release polymer coated nonwoven substrate of Example IV containing Detergent-/Softener Compositin A and Bleach/Softener Granular Composition B is made using the following procedure. The 11.4 cm×28 cm (4.5 in.×11 in.) sheet of Example IV is embossed or stretched to form a single row of 6 cells or pouches similar to the one shown in FIG. 3 herein and identified as bleach/softener cells 44 and detergent/softener cells 46. The product is made with spaced-apart printed glue pattern 12 is on the ouside surface of this embossed sheet. (For a more detailed description of preferred embossing process, see U.S. Pat. No. 4,571,924, A. S. Bahrani, issued Feb. 25, 1986, incorporated herein by reference in its entirety).

The 6 cells are each embossed to a depth of approximately 1.3 cm (0.5 in.). Each cell is approximately 3.6 cm (1.4 in.) wide and approximately 9.8 cm (3.8 in.) in length, each with about 30 cc capacity. In the embossed "bottom" sheet, two cells 44 on both ends of the sheet are each filled with approximately 14 grams (0.50 oz.) of the granular Bleach/Softener Composition B for a total of 28 grams per 6-multi-pouched product. The remaining four cells 46 are each filled with approximately 18 grams (0.64 oz.) of the granular Detergent/Softener Composition A for a total of 72 grams.

An unembossed soil release polymer coated substrate (topsheet ply) of Example IV is then attached to the filled, embossed ply by heat sealing with a printed thermal set adhesive (HA8661 Coscomelt) patterned (not shown) to correspond to the rims surrounding the 6 cells of the embossed ply for lamination sealing. The spaced-apart printed herringbone glue pattern 12 is on the outside of this unembossed sheet. There are about 3.3 grams of loose softener particles per 6-cell sheet.

The product delivers about 16 ppm of soil release polymer in a 68 liter wash solution.

EXAMPLE VII

A polyester/pul wet laid substrate (James River 5227, 10% pulp, 38.9 g/m$^2$, 1.15 ox/yd$^2$) is coated with soil release polymer according to the procedure given in Example V. The substrate (11.5 inches×15 inches) has a dry SRP coating weight of about 0.9 g and is cut into 11.4 cm×28 cm (4.5 inch x 11 inch) sheets having about 0.26 g/sheet.

This coated substrate is used as a top sheet in a more preferred 6-celled multi-pouched laundry product. This product is similar to FIG. 3 and the one of Example VI. The coated substrate of Example IV is used for the embossed sheet ply. The Detergent/Softener Composition A is supplemented with a total of about 8.5 grams of the Softener Composition of Example II.

In view of the above disclosure, one can appreciate that a preferred multi-pouched sheet article, like Examples IV or VII of this invention, is almost all that a laundry user would need. It is designed both for washer and dryer with improved soil release benefits. It can contain whiteners and stain removers, detergents and softeners to clean, soften, freshen and fight static and improvements in soil release benefits.

What is claimed is:

1. A laundry product comprising an effective amount of a soil release polymer coated on a surface of a substrate material, wherein said substrate is a water-permeable, water-insoluble material, said coated substrate material used to carry a laundry detergent composition intoan aqueous laundry solution; and wherein said soil release polymer and said laundry detergent composition are substantially distinct wherein said substrate material is used to enclose said laundry detergent composition and at least part of said substrate is coated with said soil release polymer; and wherein said product delivers from about 50 ppm to about 1,000 ppm of detergent surfactant to said laundry solution.

2. The product of claim 1 wherein said laundry detergent composition also contaains materials selected from bleach activators, bleaches, builders, enzymes and brighteners.

3. The product of claim 1 wherein said product delivers soil release polymer to the wash at a level of from about 1 ppm to about 100 ppm and detergent surfactant at a level of from about 100 ppm to about 600 ppm.

4. The product of claim 3 wherein said level is from about 5 ppm to about 25 ppm and said product delivers from about 125 ppm to about 450 ppm of said detergent surfactant.

5. The composition of claim 1 wherein said soil release polymer is selected from the group consisting of:

A. alkyl, hydroxyalkyl and mixed alkyl/hydroxyalkyl ethers of cellulose containing from one to four carbon atoms in the alkyl and hydroxyalkyl moieties and having a molar degree of substitution of about 1.5 to about 2.7 and a number average molecular weight of about 2,000 to 100,000;

B. polymers comprising ethylene terephthalate and polyethylene oxide terephthalate at mole ratio from about 1:10 to 10:1, said polyethylene oxide terephthalate containing polyethylene oxide units with a number average molecular weight from about 500 to about 10,000, and said soil release polymer having a number average molecular weight of about 1,000 to 100,000:

C. polymers comprising propylene terephthalate and polyethylene oxide terephthalate at a mole ratio from about 1:10 to about 10:1, said polyethylene oxide terephthalate containing polyethylene oxide units with a number average molecular weight from about 500 to about 10,000, and said soil release polymer having a number average molecular weight of about 1,000 to 100,000, or D. polymers comprising ethylene terephthalate and/or propylene terephthalate in any ratio such that the mole ratio of ethylene terephthalate plus propylene terephthalate topolyethylene oxide plus polypropylene oxide is from about 1:10 to about 10:1, said polyethylene oxide units and said polypropylene oxide units each having a number average molecular weight from about 250 to about 10,000, and said soil release polymer having a number average molecular weight of about 1,000 to about 100,000;

and mixtures thereof.

6. The product of claim 5 wherein said soil release polymer comprises from abou 20% to about 80% of A and from about 20% to about 80% of a polymer selected from B, C or D, and mixtures thereof.

7. The product of claim 1 wherein said substrate is selected from suitable paper tissue, synthetic nonwoven and woven fabrics, and mixtures thereof.

8. The product of claim 1 wherein said soil release polymer is a methylcellulose polymer having a molecular weight of from about 5,000 to about 50,000.

9. The product of claim 8 wherein said molecular weight is from about 10,000 to about 30,000.

10. The product of claim 1 wherein said detergent surfactant is based on an anionic surfactant system.

11. An article of manufacture adapted to provide improved fabric soil release and cleaning benefits in a laundry wash solution, said article comprising:

(a) an effective amount of a soil release polymer selected from the group consisting of water-soluble and waterdispersible soil release polymers and mixtures thereof;

(b) a water-permeable, water-insoluble substrate; and (c) a water-soluble laundry detergent composition;

wherein said (a) is coated on said (b), and said (c) is contained within a pouch made with said coated substrate.

12. An article of manufacture adapted to provide improved fabric soil release and cleaning benefits in a wash solution, said article comprising:

(a) an effective amount of a soil release polymer selected from the group consisting of water-soluble and waterdispersible soil release polymers and mixtures thereof;

(b) a water-permeable, water-insoluble substrate; and (c) a water-soluble laundry detergent composition;

wherein said laundry detergent composition is impregnated into said substrate and said soil release polymer is coated on at least one surface of said substrate; and wherein said (a) and (c) are substantially distinct.

13. The article of claim 12 wherein said product is a single sheet having said laundry detergent composition impregnated in said sheet.

* * * * *

UNITED STATES PATENT AND TRADEMARK OFFICE

CERTIFICATE OF CORRECTION

PATENT NO. : 4,740,326

DATED : April 26, 1988

INVENTOR(S) : Thomas C. Hortel, Allen D. Clauss, Leonard Williamson

It is certified that error appears in the above-identified patent and that said Letters Patent is hereby corrected as shown below:

Col. 3, line 1, "along" should be -- alone --.

Col. 3, line 39, "1000,000" should be -- 100,000 --.

Col. 4, line 10, after "is" and before "essential" insert -- an --.

Col. 4, line 64, "life" should be -- like --.

Col. 5, Table 1 in the Note: "Reemay® R" should be -- Reemay® --.

Col. 5, line 26, "bland" should be -- blend --.

Col. 5, line 40, "pun-bonded" should be -- spun-bonded --.

Col. 7, line 15, "forming" should be -- formed --.

Col. 7, line 54, after "particle" and before "at" insert -- composition wash water survival should be at least 25%, preferably --.

Col. 8, line 21, "catyl" should be -- cetyl --.

Col. 9, line 37, after "used" and before "Ethocel", "in" should be -- is --.

Col. 11, line 39, "preweighted" should be -- preweighed --.

Col. 12, line 65, "Abou" should be -- About --.

Col. 13, line 8, "s" should be -- is --.

Col. 13, line 12, "inthe" should be -- in the --.

Col. 13, line 28, "abou" should be -- about --.

Col. 13, line 42, "ouside" should be -- outside --.

UNITED STATES PATENT AND TRADEMARK OFFICE

CERTIFICATE OF CORRECTION

PATENT NO. : 4,740,326

DATED : April 26, 1988

INVENTOR(S) : Thomas C. Hortel, Allen D. Clauss, Leonard Williamson

It is certified that error appears in the above-identified patent and that said Letters Patent is hereby corrected as shown below:

Col. 14, line 3, "polyester/pul" should be -- polyester/pulp --.

Col. 14, line 31, "intoan" should be -- into an --.

Col. 14, line 40, "contaains" should be -- contains --.

Col. 15, line 8, after "ratio" and before "such" insert -- and polyethylene oxide and/or polypropylene oxide in any ratio --.

Col. 15, line 10, "topolyethylene" should be -- to polyethylene -

Col. 15, line 20, "abou" should be -- about --.

Col. 16, line 8, "waterdispersible" should be -- water dispersible --.

Col. 16, line 20, "waterdispersible" should be -- water dispersible --.

Signed and Sealed this

Twenty-fifth Day of April, 1989

*Attest:*

DONALD J. QUIGG

*Attesting Officer*

*Commissioner of Patents and Trademarks*